US012286768B2

(12) United States Patent
Tanaka et al.

(10) Patent No.: US 12,286,768 B2
(45) Date of Patent: Apr. 29, 2025

(54) WORK MACHINE

(71) Applicant: HITACHI CONSTRUCTION MACHINERY CO., LTD., Tokyo (JP)

(72) Inventors: Hiroaki Tanaka, Kasumigaura (JP); Yusuke Suzuki, Tsukuba (JP); Akihiro Narazaki, Tsukuba (JP); Yasuhiko Kanari, Kasumigaura (JP); Hiroshi Sakamoto, Kashiwa (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 254 days.

(21) Appl. No.: 18/022,787

(22) PCT Filed: Nov. 9, 2021

(86) PCT No.: PCT/JP2021/041241
§ 371 (c)(1),
(2) Date: Feb. 23, 2023

(87) PCT Pub. No.: WO2022/208972
PCT Pub. Date: Oct. 6, 2022

(65) Prior Publication Data

US 2023/0304260 A1 Sep. 28, 2023

(30) Foreign Application Priority Data

Mar. 30, 2021 (JP) ..... 2021-058509

(51) Int. Cl.
*E02F 9/20* (2006.01)
*E02F 3/32* (2006.01)
(Continued)

(52) U.S. Cl.
CPC ..... *E02F 9/2033* (2013.01); *E02F 3/32* (2013.01); *E02F 3/435* (2013.01); *E02F 9/123* (2013.01);
(Continued)

(58) Field of Classification Search
None
See application file for complete search history.

(56) References Cited

U.S. PATENT DOCUMENTS 5,822,891 A * 10/1998 Fujishima ..... E02F 9/2033 701/50
2017/0268198 A1 9/2017 Shimano et al.
(Continued)

FOREIGN PATENT DOCUMENTS

JP 09-105152 A 4/1997
JP 09-256406 A 9/1997
(Continued)

OTHER PUBLICATIONS

International Preliminary Report on Patentability received in corresponding International Application No. PCT/JP2021/041241 dated Oct. 12, 2023.
(Continued)

*Primary Examiner* — Todd Melton
*Assistant Examiner* — Jason R Roberson
(74) *Attorney, Agent, or Firm* — MATTINGLY & MALUR, PC

(57) ABSTRACT

The invention of the present application has as its object the provision of a work machine that is equipped with a function to prevent a work device thereof from going into an entry prohibited area and can satisfy both working precision and working efficiency of the work device. A controller is therefore configured to start work range limiting control to decelerate or stop an action of a machine main body or the work device when a distance between a monitor point set beforehand on the work device and the entry prohibited area decreases to a first distance, to end the work range limiting control when the distance between the monitor point and the entry prohibited area increases to a second distance greater
(Continued)

than the first distance, and to change the second distance according to an operation amount of an operation device.

8 Claims, 13 Drawing Sheets

(51) Int. Cl.

| | |
|---|---|
| ***E02F 3/43*** | (2006.01) |
| ***E02F 9/02*** | (2006.01) |
| ***E02F 9/12*** | (2006.01) |
| ***E02F 9/22*** | (2006.01) |
| ***E02F 9/24*** | (2006.01) |

(52) U.S. Cl.
CPC ..... *E02F 9/2271* (2013.01); *E02F 9/24* (2013.01); *E02F 9/02* (2013.01); *E02F 9/2228* (2013.01)

(56) References Cited

U.S. PATENT DOCUMENTS

| | | | | |
|---|---|---|---|---|
| 2018/0148905 | A1 | 5/2018 | Matsuyama et al. | |
| 2018/0179734 | A1* | 6/2018 | Yamashita | E02F 9/2033 |
| 2019/0284782 | A1 | 9/2019 | Izumikawa | |
| 2021/0047798 | A1* | 2/2021 | Kamimura | E02F 9/24 |
| 2021/0230837 | A1 | 7/2021 | Narikawa et al. | |
| 2022/0205225 | A1* | 6/2022 | Shiratani | E02F 9/2282 |

FOREIGN PATENT DOCUMENTS

| | | | |
|---|---|---|---|
| JP | 2016-176289 | A | 10/2016 |
| WO | 2016/133225 | A1 | 8/2016 |
| WO | 2018/105527 | A1 | 6/2018 |
| WO | 2020/054154 | A1 | 3/2020 |

OTHER PUBLICATIONS

International Search Report of PCT/JP2021/041241 dated Dec. 14, 2021.

Extended European Search Report received in corresponding European Application No. 21935128.5 dated Aug. 6, 2024.

* cited by examiner

WORK MACHINE

TECHNICAL FIELD

The present invention relates to control of a work machine such as a hydraulic excavator.

BACKGROUND ART

As a hydraulic system for a work machine such as a conventional hydraulic excavator, there is one including a hydraulic pump that is driven by a prime mover such as an engine, actuators that drive a machine body and a front implement (work device), and directional control valves that control directions and flow rates of hydraulic fluid to be supplied from the hydraulic pump to the actuators. An operator of the work machine can provide instructions on an action direction and an action velocity of each actuator by operating a corresponding operation device such as a control lever.

Further, as a work range limiting control system for a construction machine that, when the front implement is stopped right before an entry prohibited area set beforehand, prevents the front implement from going into the entry prohibited area or to generate a shock through an inadvertent operation of an actuator by a subsequent lever operation, there is one described in Patent Document 1.

In Patent Document 1, there is described a work range limiting control system for a construction machine including an articulated front implement constituted of a plurality of front members pivotable in an up-down direction, a plurality of hydraulic actuators that drive the plurality of front members, a plurality of operating means that provide instructions on actions of the plurality of front members, and a plurality of flow control valves that are driven according to operations of the plurality of operating means and control flow rates of hydraulic fluid to be supplied to the plurality of hydraulic actuators. The work range limiting control system is incorporated in the construction machine, in which the plurality of operating means are a plurality of pilot operation devices that output operation pilot pressures and drive the corresponding flow control valves, and is configured to compute and output a command current value according to a distance between a monitor point set beforehand with respect to the front implement and an entry prohibited area set beforehand, to decelerate the front implement when the monitor point approaches the entry prohibited area, and to stop the front implement when the monitor point reaches the entry prohibited area. The work range limiting control system includes an electric pressure reducing valve that is disposed between at least one of the pilot operation devices and corresponding one of the flow control valves, reduces the operation pilot pressure, the operation pilot pressure having been outputted from the pilot operation device, according to the command current value, and outputs the reduced operation pilot pressure, deceleration computing means that computes the command current value such that the command current value decreases as the distance between the monitor point and the entry prohibited area decreases, and signal reduction processing means that changes the command current value having been computed by the deceleration computing means to a low current value, the low current value being to stop the front implement completely, and outputs the low current value to the electric pressure reducing valve when the monitor point is located in a predetermined range from the entry prohibited area to right before the entry prohibited area. The signal reduction processing means performs a hysteresis computation to make a distance of the predetermined range longer when the monitor point recedes from the entry prohibited area than when the monitor point approaches the entry prohibited area.

PRIOR ART DOCUMENT

Patent Document

Patent Document 1: JP-H09-105152-A

SUMMARY OF THE INVENTION

Problem to be Solved by the Invention

In the work range limiting control system described in Patent Document 1, if the difference (hysteresis width) between the distance of the predetermined range (an area where the front implement is to be decelerated) when the monitor point approaches the entry prohibited area and the distance of the predetermined range when the monitor point recedes from the entry prohibited area is made greater, a velocity limitation to each actuator for the entry prohibited area becomes stricter, so that working efficiency may be reduced while working precision can be improved. If the hysteresis width is made smaller conversely, the velocity limitation of each actuator for the entry prohibited area is relaxed, so that the working precision may be reduced while the working efficiency can be improved. With the work range limiting control system described in Patent Document 1, it is therefore difficult to simultaneously satisfy the requirements for working precision and working efficiency.

With the above-described problem in view, the present invention has as an object thereof the provision of a work machine that is equipped with a function to prevent a work device thereof from going into an entry prohibited area and can satisfy both the working precision and the working efficiency of the work device.

Means for Solving the Problem

To achieve the above-described object, the present invention provides a work machine including an operation device that provides instructions on actions of the machine main body and the work device, and a controller that performs work range limiting control to decelerate or stop an action of the machine main body or the work device according to a distance between a monitor point set on the work device and an entry prohibited area such that the monitor point does not enter the entry prohibited area, the controller starting the work range limiting control when the distance between the monitor point and the entry prohibited area decreases to a first distance, and ending the work range limiting control when the distance between the monitor point and the entry prohibited area increases to a second distance greater than the first distance. In this work machine, the controller is configured to change the second distance according to an operation amount of the operation device.

According to the present invention configured as described above, it is possible, in the work machine equipped with the function to prevent the work device from going into the entry prohibited area, to satisfy both the working precision and the working efficiency of the work device by changing the hysteresis width of a target surface distance (a difference between the first distance and the second distance) according to the operation amount of the operation device.

Advantages of the Invention

According to the present invention, it is possible, in a work machine equipped with a function to prevent a work device thereof from going into an entry prohibited area, to satisfy both the working precision and the working efficiency of the work device.

MODES FOR CARRYING OUT THE INVENTION

Figure 1:
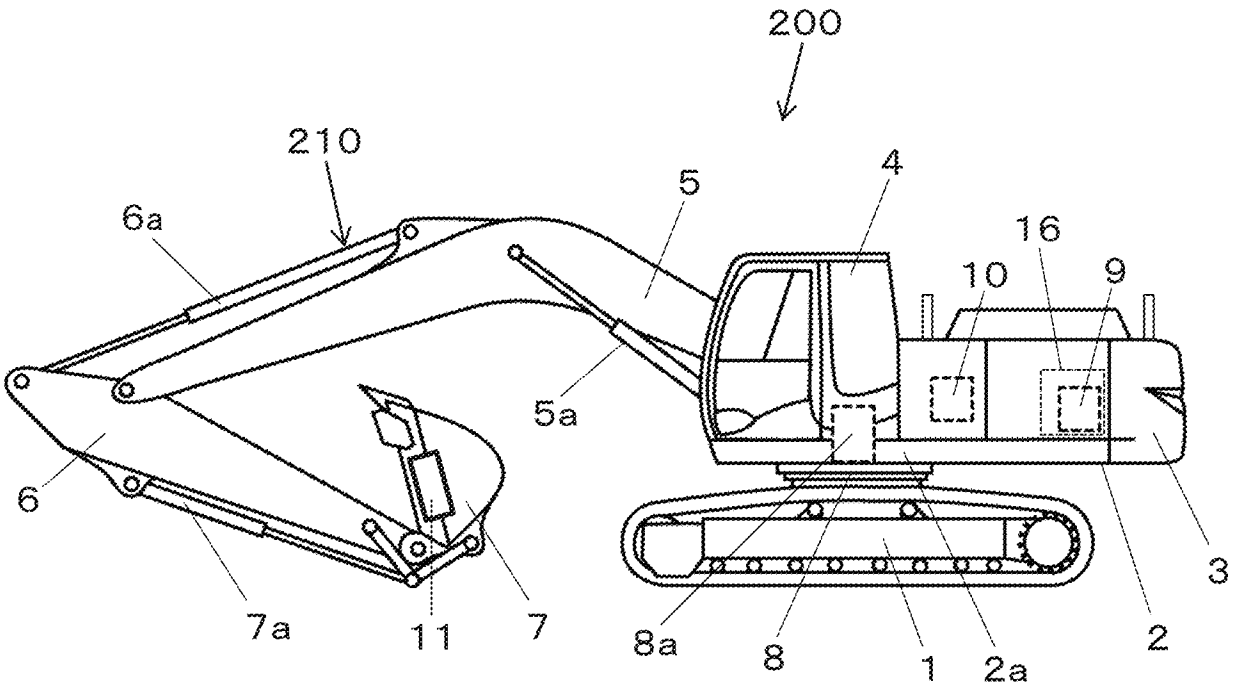
FIG. 1 is a side view of a hydraulic excavator according to a first embodiment of the present invention.

Taking a hydraulic excavator as an example of a work machine embodying the present invention, a description will hereinafter be made with reference to the drawings. It is to be noted that, in the individual figures, equivalent elements are identified by the same reference characters, and their repeated descriptions are omitted.

First Embodiment

FIG. 1 is a side view of a hydraulic excavator according to a first embodiment of the present invention. As illustrated in FIG. 1, the hydraulic excavator 200 includes a lower track structure 1, an upper swing structure 2 swingably mounted as a machine main body on the lower track structure 1 via a swing device 8, and a work device 210 connected pivotably in an up-down direction to a front side of the upper swing structure 2.

The upper swing structure 2 has a swing frame 2*a* that serves as a lower base structure. To a front side of the swing frame 2*a*, the work device 210 is connected pivotably in the up-down direction. On a rear side of the swing frame 2*a*, a counterweight 3 is mounted to keep a weight balance with the work device 210. On a front part on a left side of the swing frame 2*a*, a cab 4 is disposed. Inside the cab 4, a left control lever 15L and a right control lever 15R (illustrated in FIG. 2), which are operation devices for operating the upper swing structure 2 and the work device 210, and the like are arranged. On the swing frame 2*a*, an engine 16 as a prime mover, a pump unit 9 constituted from one or a plurality of hydraulic pumps driven by the engine 16, a swing motor 8*a* that drives the swing device 8, a control valve unit 10 constituted from a plurality of directional control valves, and the like are mounted. The control valve unit 10 controls flows of hydraulic fluid to be supplied from the pump unit 9 to the swing motor 8*a* and a plurality of actuators including a boom cylinder 5*a*, an arm cylinder 6*a*, and a bucket cylinder 7*a* to be mentioned below.

The work device 210 includes a boom 5 that is connected at a proximal end portion thereof pivotably in the up-down direction to a front part on a right side of the swing frame 2*a*, an arm 6 that is connected pivotably in the up-down direction and a front-rear direction to a distal end portion of the boom 5 and is raised or lowered by the boom 5, a bucket 7 that, as a work instrument, is connected pivotably in the up-down and front-rear directions to a distal end portion of the arm 6 and is raised or lowered by the boom 5 or the arm 6, the boom cylinder 5*a* that drives the boom 5, the arm cylinder 6*a* that drives the arm 6, and the bucket cylinder 7*a* that drives the bucket 7.

To the bucket 7, a bucket position measurement system 11 is attached. In FIG. 1, the bucket position measurement system 11 is illustrated as one that directly measures a bucket position. In general, however, the bucket position measurement system 11 is a system configured to compute a bucket position from respective positional relations between the upper swing structure 2, the boom 5, the arm 6, and the bucket 7 and is formed of angle sensors or IMUs disposed on the upper swing structure 2, the boom 5, the arm 6, and the bucket 7.

Figure 2:
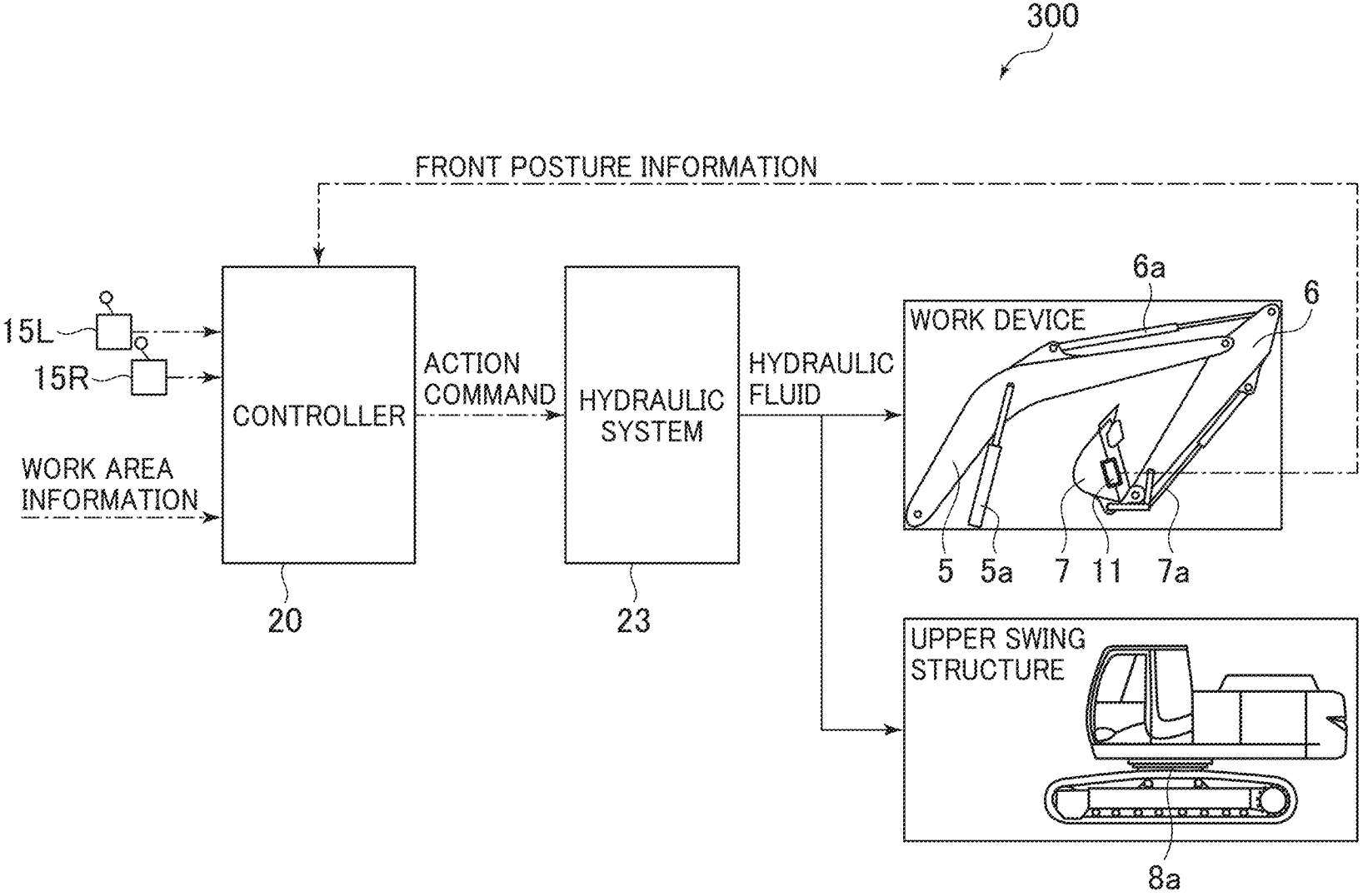
FIG. 2 is a configuration diagram of a hydraulic control system in the first embodiment of the present invention.

FIG. 2 is a schematic configuration diagram of a hydraulic control system mounted on the hydraulic excavator 200. As illustrated in FIG. 2, the hydraulic control system 300 includes a controller 20 as a control system, a hydraulic system 23, the control levers 15L and 15R, and the bucket position measurement system 11.

The control levers 15L and 15R are devices for allowing an operator to instruct the controller 20 on actions of the hydraulic excavator 200, and output to the controller 20 operation signals that correspond to lever operations by the operator. An operation of the right control lever 15R in the front-rear direction corresponds to an action of the boom 5 while its operation in a left-right direction corresponds to an action of the bucket 7. An operation of the left control lever 15L in the front-rear direction corresponds to a swing action while its operation in the left-right direction corresponds to an action of the arm 6. The controller 20 outputs action commands to the hydraulic system 23 according to the operation signals from the control levers 15L and 15R, work area information, and posture information from the bucket position measurement system 11.

The hydraulic system 23 supplies hydraulic fluid to the boom cylinder 5*a*, the arm cylinder 6*a*, the bucket cylinder 7*a*, and the swing motor 8*a* according to the action commands from the controller 20 to drive the boom 5, the arm 6, the bucket 7, and the swing device 8.

Figure 3:
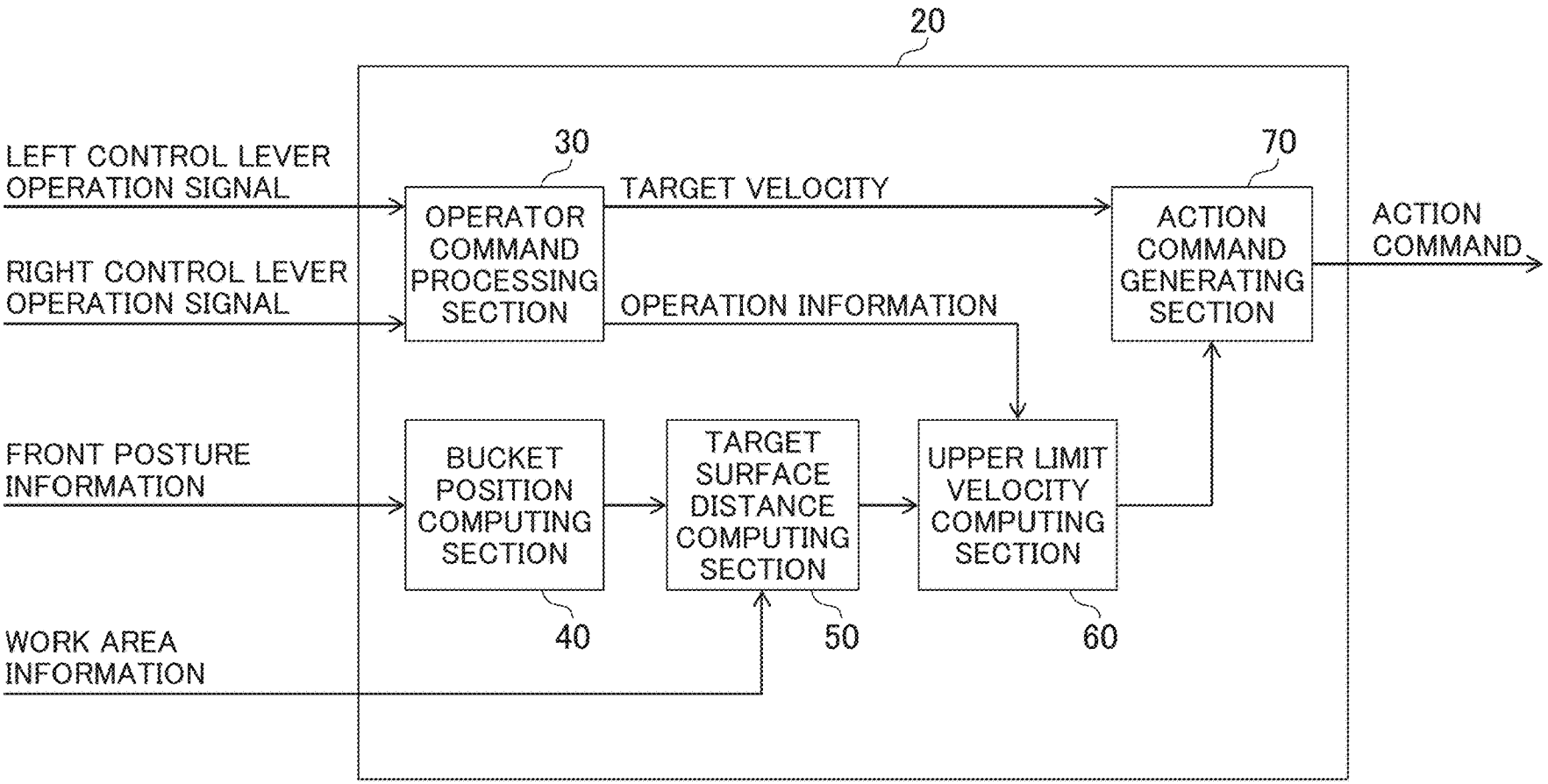
FIG. 3 is a function block diagram of a controller in the first embodiment of the present invention.

FIG. 3 is a function block diagram of the controller 20. As illustrated in FIG. 3, the controller 20 has an operator command processing section 30, a bucket position computing section 40, a target surface distance computing section 50, an upper limit velocity computing section 60, and an action command generating section 70.

The operator command processing section 30 decides target velocities of the actuators 5*a*, 6*a*, 7*a*, and 8*a* on the basis of operation signals from the control levers 15L and 15R and outputs them to the action command generating section 70. Further, the operator command processing section 30 generates operation information of operations made by the operator, on the basis of the operation signals from the control levers 15L and 15R, and outputs it to the upper limit velocity computing section 60.

The bucket position computing section 40 computes a bucket position on the basis of front posture information and outputs it to the target surface distance computing section 50. The target surface distance computing section 50 computes a distance from the bucket 7 to a construction target surface (a target surface distance) on the basis of the work area information and the bucket position and outputs it to the upper limit velocity computing section 60. Here, the work area means an area where it is allowed to carry out work by the hydraulic excavator 200, and includes working drawing information and position information of obstacles and the like. Hereinafter, an area outside the work area is called the "entry prohibited area," and a boundary surface between the work area and the entry prohibited area is called the "target surface."

The upper limit velocity computing section 60 computes upper limit velocities of the actuators 5*a*, 6*a*, 7*a*, and 8*a* on the basis of the operation information and the target surface distance and outputs them to the action command generating section 70. The action command generating section 70 corrects the target velocities of the actuators 5*a*, 6*a*, 7*a*, and 8*a* such that a velocity of a monitor point, which has been set beforehand on the work device 210 (for example, at a position of a claw tip of the bucket 7), in an approaching direction toward the entry prohibited area becomes its upper limit velocity or lower, and outputs to the hydraulic system 23 action commands corresponding to the target velocities thus corrected. The control to decelerate or stop the action of the machine main body 2 or the work device 210 according to the distance between the monitor point and the entry prohibited area (the target surface distance) such that the monitor point does not enter the entry prohibited area as described above is called the "work range limiting control."

Figure 4:
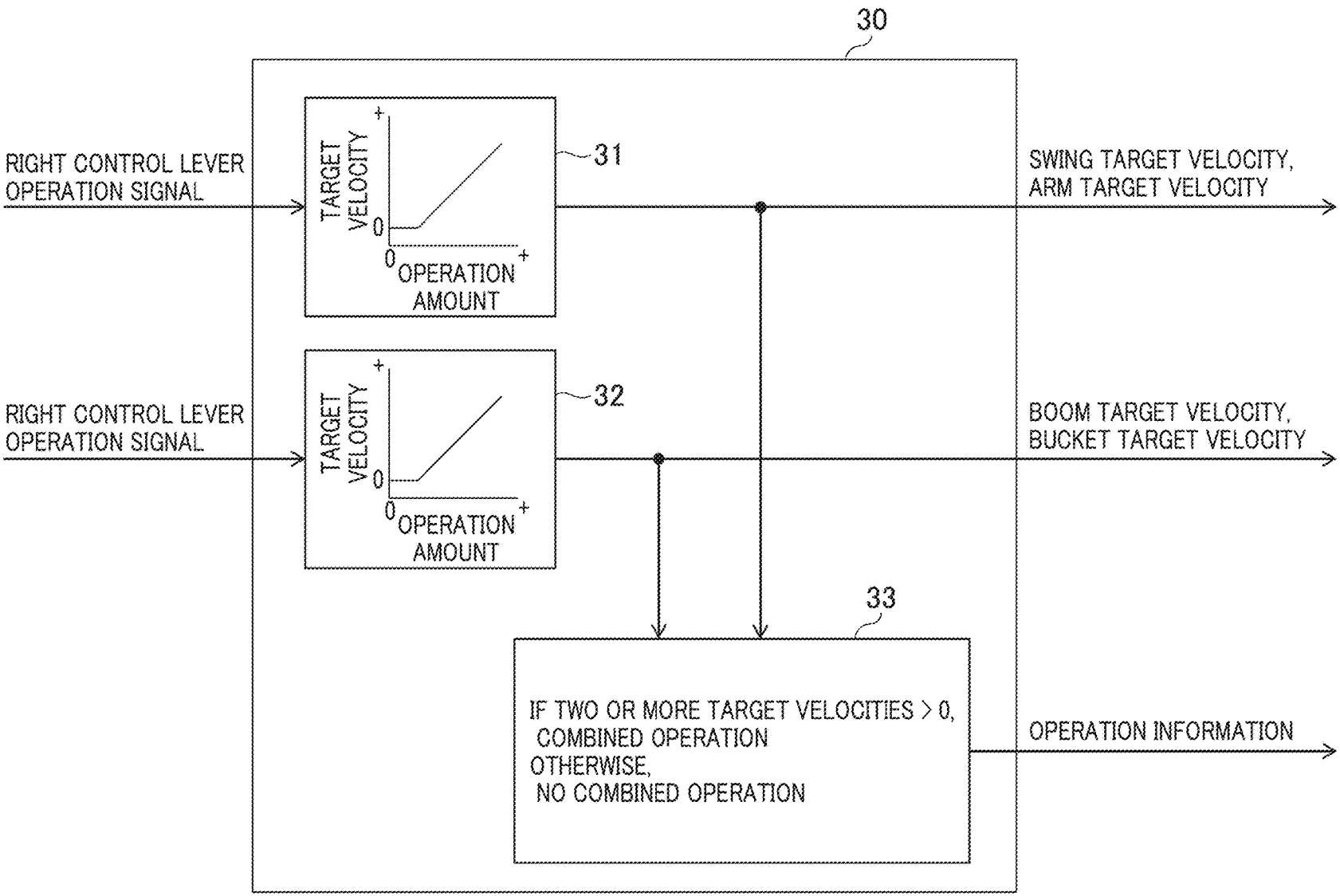
FIG. 4 is a diagram illustrating processing by an operator command processing section in the first embodiment of the present invention.

FIG. 4 is a diagram illustrating processing by the operator command processing section 30. As illustrated in FIG. 4, the operator command processing section 30 has a first target velocity computing section 31, a second target velocity computing section 32, and an operation determining section 33.

The first target velocity computing section 31, using a table set beforehand, converts an operation amount in the front-rear direction of the left control lever 15L to a target velocity of the upper swing structure 2 (target swing velocity) and also converts an operation amount in the left-right direction of the left control lever 15L to a target velocity of the arm 6 (arm target velocity), and outputs the respective target velocities to the operation determining section 33 and the action command generating section 70 (illustrated in FIG. 3). It is to be noted that a dead zone is included in each of the operation amounts and the target velocity is kept at zero until the operation amount exceeds a predetermined value.

The second target velocity computing section 32, using a table set beforehand, converts an operation amount in the front-rear direction of the right control lever 15R to a target velocity of the boom 5 (boom target velocity) and also converts an operation amount in the left-right direction of the right control lever 15R to a target velocity of the bucket 7 (bucket target velocity), and outputs the respective target velocities to the operation determining section 33 and the action command generating section 70 (illustrated in FIG. 3). It is to be noted that, in the respective tables in the first target velocity computing section 31 and the second target velocity computing section 32, a dead zone is included in each of the operation amounts such that the target velocity is kept at zero until the operation amount exceeds a predetermined value.

The operation determining section 33 determines that a "combined operation" is to be performed if any two or more of the boom target velocity, the bucket target velocity, the boom target velocity, and the target swing velocity are greater than 0, and otherwise determines that "no combined operation" is to be performed, and outputs the determination result as operation information to the upper limit velocity computing section 60 (illustrated in FIG. 3).

Figure 5:
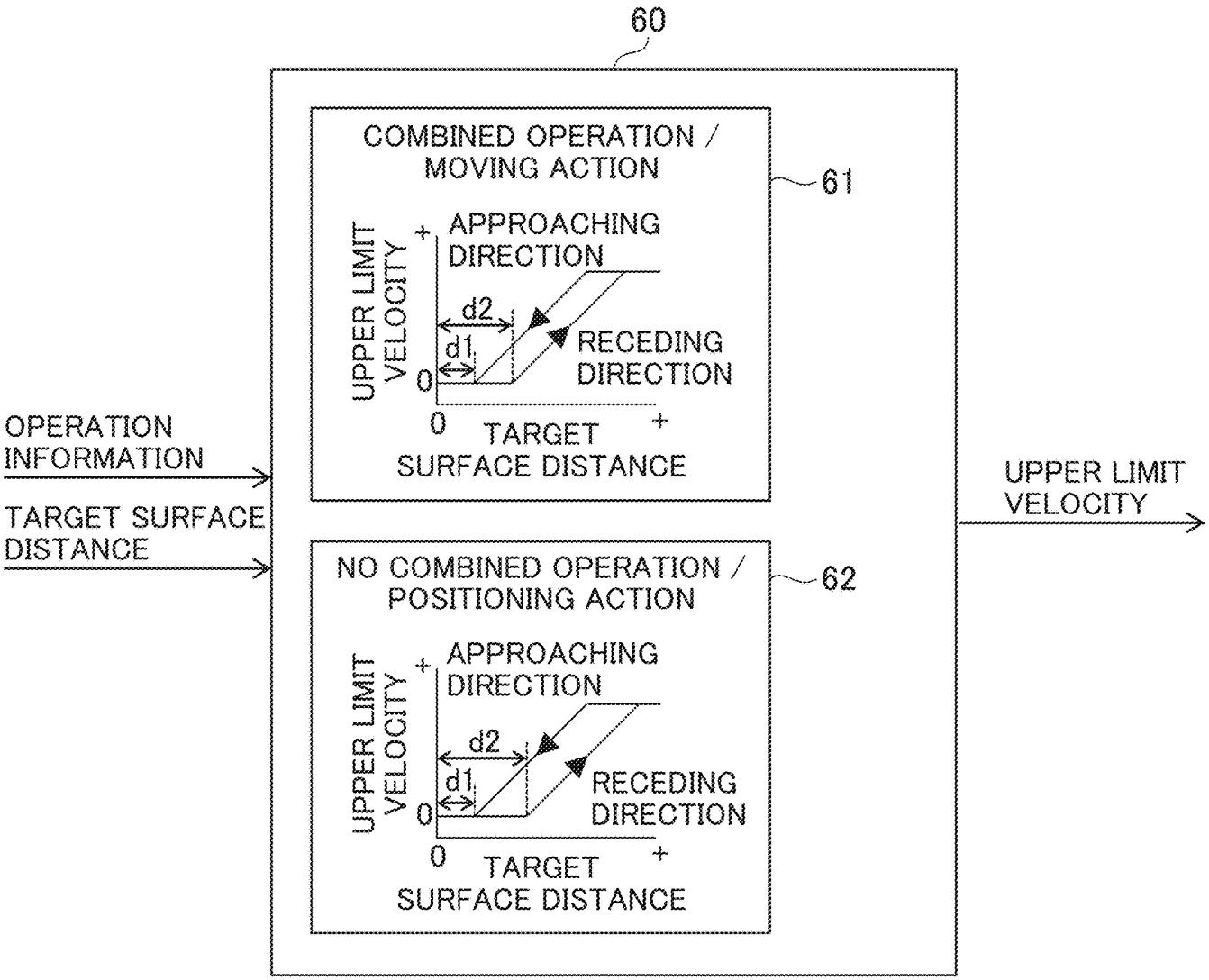
FIG. 5 is a diagram illustrating processing by an upper limit velocity computing section in the first embodiment of the present invention.

FIG. 5 is a diagram illustrating processing by the upper limit velocity computing section 60. As illustrated in FIG. 5, the upper limit velocity computing section 60 has a first upper limit velocity computing section 61 and a second upper limit velocity computing section 62. Each of the first upper limit velocity computing section 61 and the second upper limit velocity computing section 62, using a table set beforehand, converts a target surface distance to an upper limit velocity and outputs it to the action command generating section 70 (illustrated in FIG. 3). The upper limit velocity as referred to here is set for the velocity of the monitor point in an approaching direction toward the entry prohibited area.

The upper limit velocity computing section 60 selectively uses the first upper limit velocity computing section 61 and the second upper limit velocity computing section 62 according to the operation information. The first upper limit velocity computing section 61 converts the target surface distance to the upper limit velocity if the operation information indicates "combined operation," while the second upper limit velocity computing section 62 converts the target surface distance to the upper limit velocity if the operation information indicates "no combined operation." It is to be noted that, in the present embodiment, a case in which the operation information indicates "combined operation" is determined as a moving action while a case in which the operation information indicates "no combined operation" is determined as a positioning action.

The first upper limit velocity computing section 61 reduces the upper limit velocity according to a decrease of the target surface distance and sets the upper limit velocity at zero when the target surface distance decreases to a predetermined first distance d1 or smaller, if the work device 210 moves in such a direction that the monitor point approaches the construction target surface. On the other hand, if the work device 210 moves in such a direction that the monitor point recedes from the construction target surface, the first upper limit velocity computing section 61 keeps the upper limit velocity at zero until the target surface distance increases to reach a predetermined second distance d2, which is greater than the predetermined first distance d1, and raises the upper limit velocity according to the increase of the target surface distance when the target surface distance exceeds the second distance d2. That is, the work range limiting control is started when the target surface distance decreases to the first distance d1 or smaller, and is ended when the target surface distance increases to the second distance d2 or greater.

The second upper limit velocity computing section 62 has a similar basic configuration as the first upper limit velocity computing section 61, but a hysteresis width (=d2−d1) is larger than that in the first upper limit velocity computing section 61. In other words, the second distance d2 in the second upper limit velocity computing section 62 is set at a value greater than the second distance d2 in the first upper limit velocity computing section 61. This makes it possible to prevent a reacceleration under automatic control by suppressing pitching of the work device 210 in the case of no combined operation (positioning action). In the case of a combined operation (moving action), on the other hand, the setting of a smaller hysteresis width than in the case of no combined operation (positioning action) allows pitching of the work device 210 thereby enabling continuation of the action of the work device 210.

Figure 6:
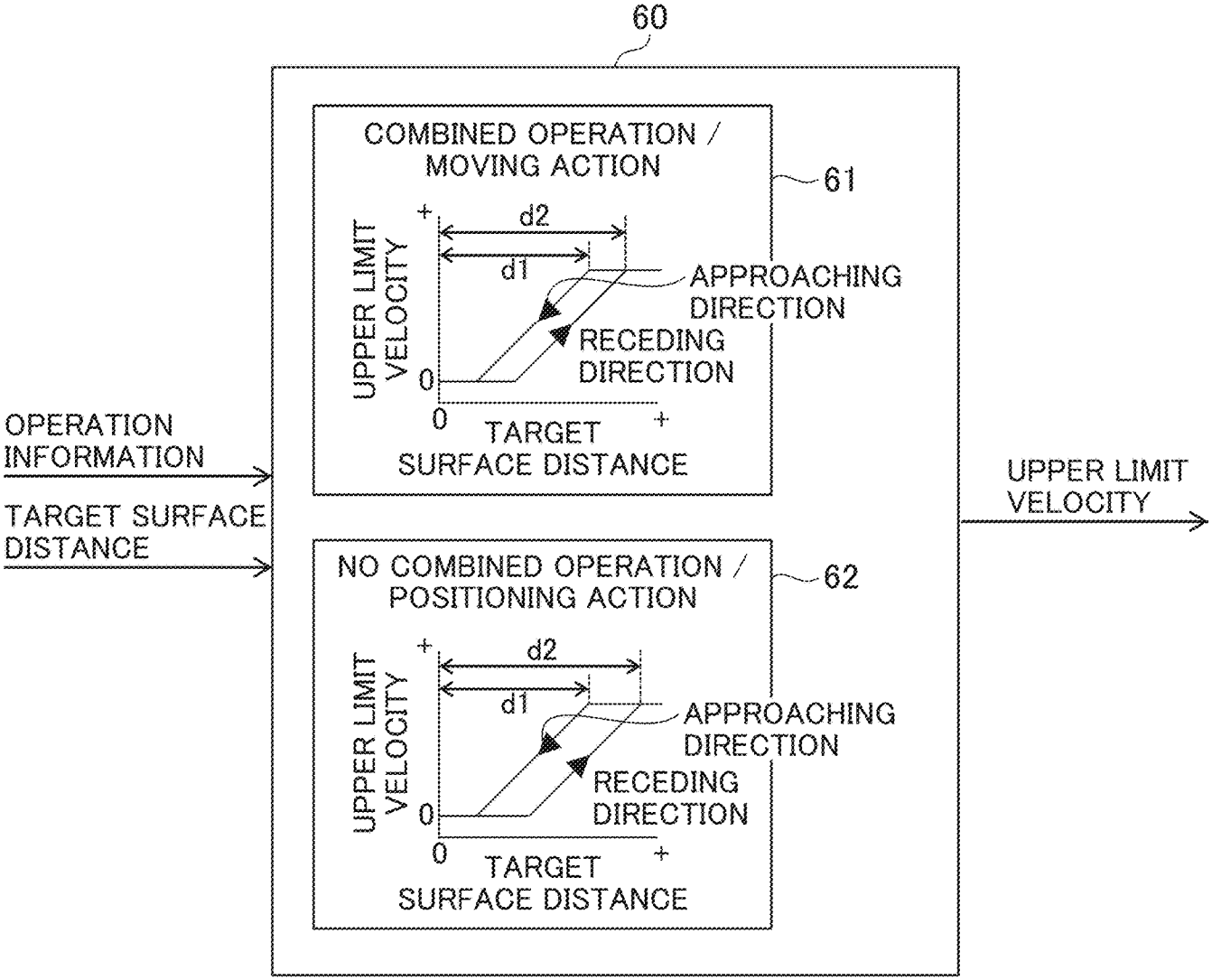
FIG. 6 is a diagram illustrating a modification of the processing by the upper limit velocity computing section in the first embodiment of the present invention.

It is to be noted that, in the example illustrated in FIG. 5, the first distance d1 and the second distance d2 are defined by the target surface distance obtained when the upper limit velocity is set at zero (when the movement in such a direction that the monitor point approaches the entry prohibited area is stopped). As illustrated in FIG. 6, however, the first distance d1 or the second distance d2 may also be defined by a target surface distance obtained when the upper limit velocity is reduced (when the movement in such a direction that the monitor point approaches the entry prohibited area is decelerated).

SUMMARY

In the present embodiment, in the work machine 200 including the machine main body 2, the articulated work device 210 including the work instrument 7, the operation devices 15L and 15R that provide instructions on actions of the machine main body 2 and the work device 210, and the controller 20 that performs work range limiting control to decelerate or stop the action of the machine main body 2 or the work device 210 according to the distance between the monitor point set on the work device 210 and the entry prohibited area such that the monitor point does not enter the entry prohibited area, the work device 210, the operation devices 15L and 15R, and the controller 20 being mounted on the machine main body 2, the controller 20 starting the work range limiting control when the distance between the monitor point and the entry prohibited area decreases to the first distance d1, and ending the work range limiting control when the distance between the monitor point and the entry prohibited area increases to the second distance d2 greater than the first distance d1, the controller 20 changes the second distance d2 according to the operation amount of the operation device 15L or 15R.

According to the present embodiment configured as described above, in the work machine 200 equipped with a function to prevent the work device 210 from going into the entry prohibited area, working precision and working efficiency of the work device 210 can both be satisfied by changing the hysteresis width of the target surface distance (a difference between the first distance d1 and the second distance d2) according to the operation amount of the operation device 15L or 15R.

Further, the controller 20 in the present embodiment determines, on the basis of the operation amounts of the operation devices 15L and 15R, whether the action of the work device 210 is a positioning action to decide the position of the work instrument 7 or is a moving action to move the work instrument 7, and sets the second distance d2 at a predetermined first value (the second distance d2 in the second upper limit velocity computing section 62) if the action of the work device 210 is determined as the positioning action, or sets the second distance d2 at a predetermined second value smaller than the predetermined first value (the second distance d2 in the first upper limit velocity computing section 61) if the action of the work device 210 is determined as the moving action. This makes it possible to suppress pitching of the work device 210 by making larger the hysteresis width of the target surface distance (the difference between the first distance d1 and the second distance d2) during a positioning action of the work device 210. During a moving action of the work device 210, on the other hand, pitching of the work device 210 is allowed to enable continuation of the action of the work device 210 by making the hysteresis width smaller than that during the positioning action. Accordingly, it is possible to improve the working efficiency of the work device 210 during a moving action while maintaining the working precision of the work device 210 during a positioning action.

Further, the work machine 200 in the present embodiment includes the plurality of actuators 5*a*, 6*a*, and 7*a* to make actions of the work device 210, and the controller 20 determines, on the basis of operation amounts of the operation devices 15L and 15R, whether an operation of the operation devices 15L and 15R is a combined operation that simultaneously operates two or more of the plurality of actuators 5*a*, 6*a*, and 7*a*, and determines the action of the work device 210 as the moving action if the operation of the operation devices 15L and 15R is determined as the combined operation, but determines the action of the work device 210 as the positioning action if the operation of the operation devices 15L and 15R is determined not to be the combined operation. Accordingly, it is possible to easily determine whether the action of the work device 210 is a positioning action or a moving action.

Moreover, the controller 20 in the present embodiment determines the operation of the operation devices 15L and 15R to be the combined operation if two or more of the plurality of actuators 5*a*, 6*a*, 7*a*, and 8*a* have a target velocity greater than zero, and determines the operation of the operation devices 15L and 15R not to be the combined operation if one or less of the plurality of actuators 5*a*, 6*a*, 7*a*, and 8*a* has a target velocity greater than zero. Accordingly, it is possible to determine, on the basis of the target velocities of the plurality of actuators 5*a*, 6*a*, 7*a*, and 8*a*, whether or not the operation of the operation devices 15L and 15R is a combined operation.

In addition, the controller 20 in the present embodiment may also determine the action of the work device 210 as the positioning action if a velocity component of the monitor point perpendicular to the entry prohibited area is larger than a velocity component thereof parallel to the entry prohibited area, and may also determine the action of the work device 210 as the moving action if the perpendicular velocity component is equal to or smaller than the parallel velocity component. Accordingly, it is possible to determine, on the basis of the moving direction of the monitor point relative to the entry prohibited area, whether the action of the work device 210 is a positioning action or a moving action.

Second Embodiment

About a work machine according to a second embodiment of the present invention, a description will be made centering around differences from the first embodiment.

Figure 7:
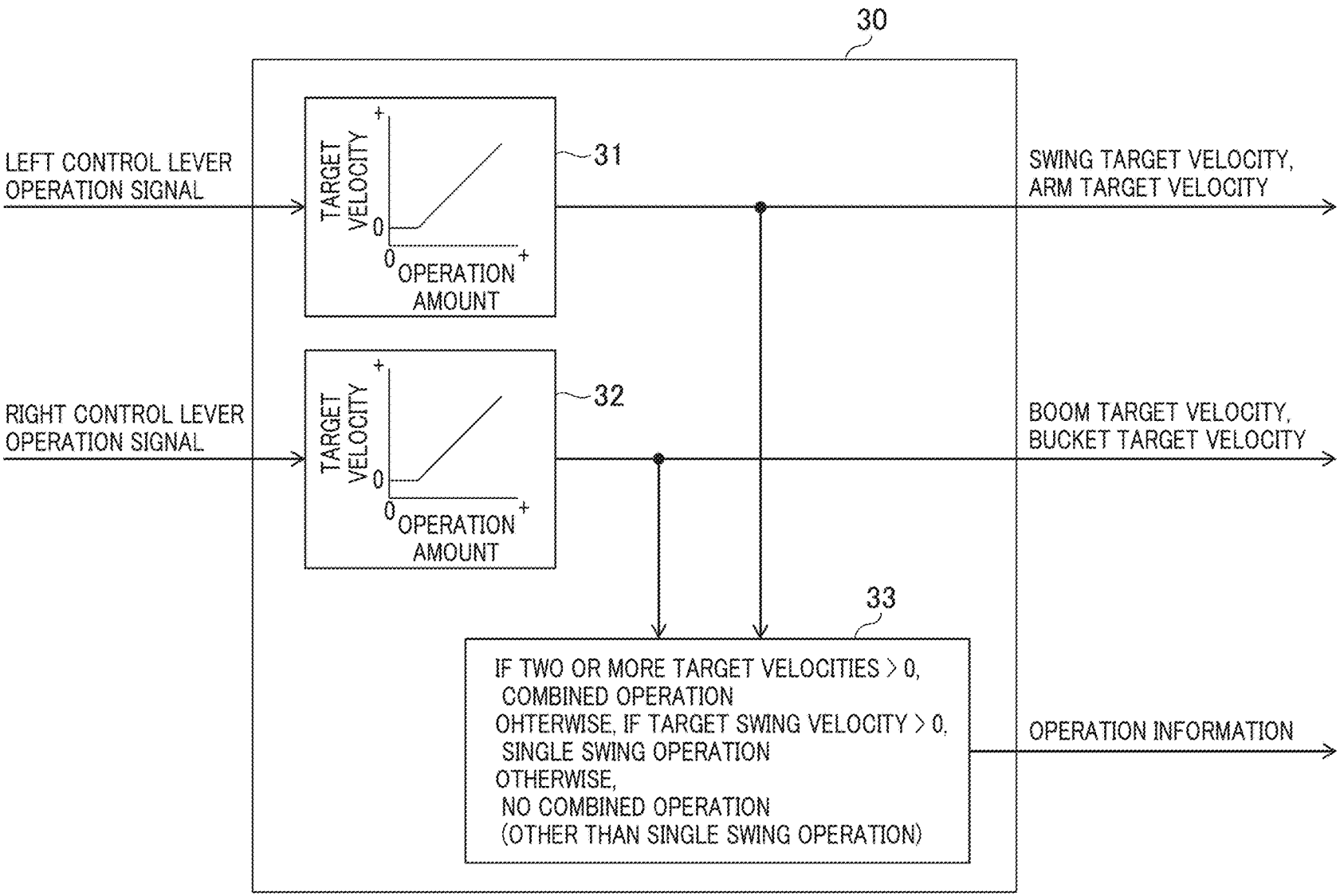
FIG. 7 is a diagram illustrating processing by the operator command processing section in a second embodiment of the present invention.

FIG. 7 is a diagram illustrating processing by the operator command processing section 30 in the present embodiment. In FIG. 7, the operation determining section 33 determines that a "combined operation" is to be performed if any two or more of the boom target velocity, the bucket target velocity, the boom target velocity, and the target swing velocity are greater than 0, determines that a "single swing operation" is to be performed if only the target swing velocity is greater than 0, and otherwise determines that "no combined operation (other than single swing operation)" is to be performed.

Figure 8:
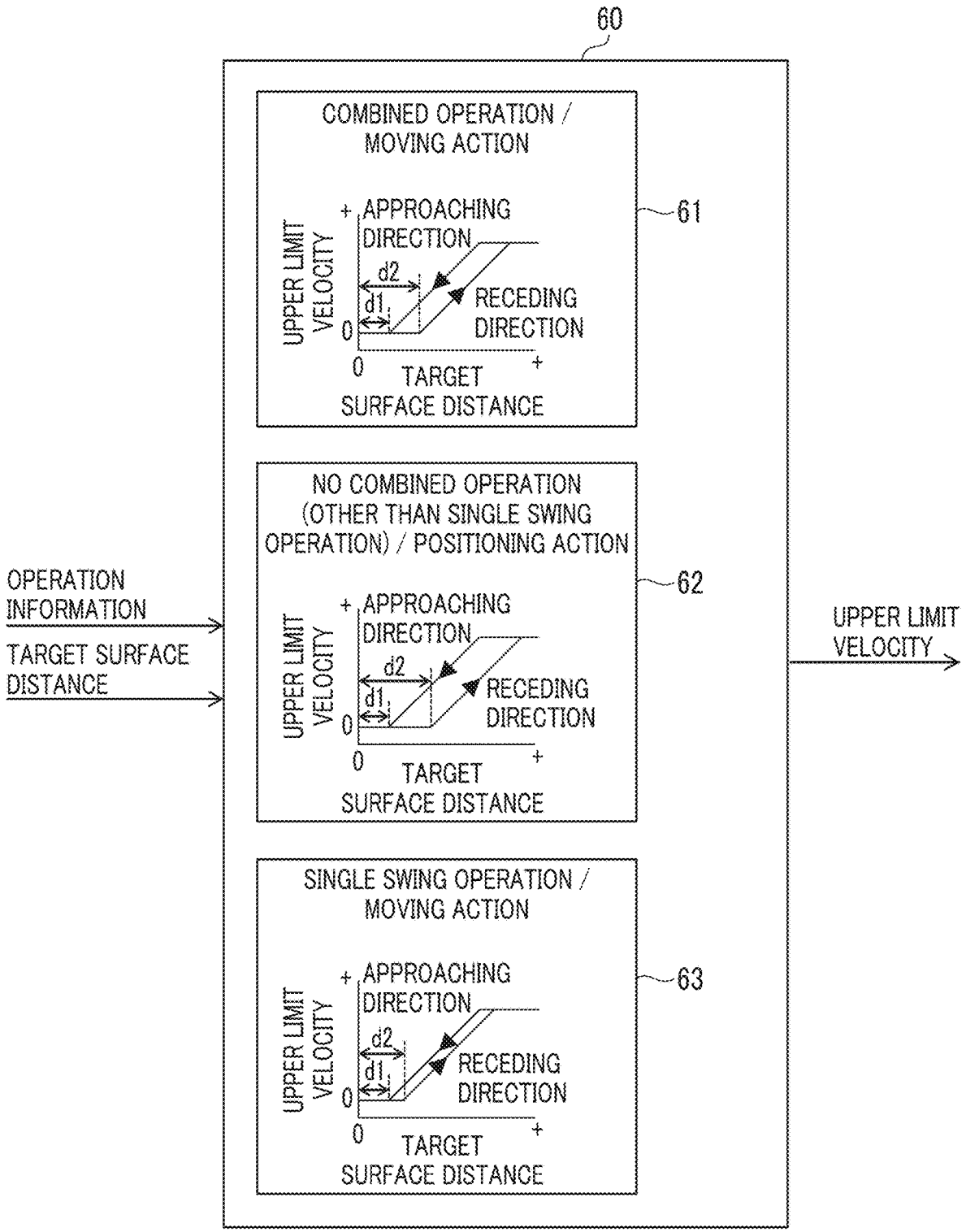
FIG. 8 is a diagram illustrating processing by the upper limit velocity computing section in the second embodiment of the present invention.

FIG. 8 is a diagram illustrating processing by the upper limit velocity computing section 60 in the present embodiment. In FIG. 8, the upper limit velocity computing section 60 has a third upper limit velocity computing section 63 in addition to the first upper limit velocity computing section 61 and the second upper limit velocity computing section 62. The third upper limit velocity computing section 63 converts a target surface distance to an upper limit velocity if operation information indicates "single swing operation." It is to be noted that, in the present embodiment, a case in which the operation information indicates "combined operation" or "single swing operation" is determined as a moving action, and a case in which the operation information indicates "no combined operation (other than single swing operation)" is determined as a positioning action.

The third upper limit velocity computing section 63 has a basic configuration similar to that of the first upper limit velocity computing section 61 and the second upper limit velocity computing section 62, but the hysteresis width (=d2-d1) of the target surface distance is smaller than the hysteresis width in the first upper limit velocity computing section 61. In other words, the second width d2 in the third upper limit velocity computing section 63 is set at a value smaller than the second width d2 in the first upper limit velocity computing section 61.

Here, the reason will be mentioned on the setting of a smaller hysteresis width in a single swing operation (the third upper limit velocity computing section 63) than in other single operations (the first upper limit velocity computing section 61). Assuming that the action directions of the boom 5, the arm 6, and the bucket 7 are each an upright direction, the action direction of the upper swing structure 2 is a lateral direction. Pitching in the upright direction of the upper swing structure 2 or the work device 210 associated with a single swing action is therefore smaller than pitching in the upright direction of the upper swing structure 2 or the work device 210 associated with an action of the boom 5, the arm 6, or the bucket 7. Hence, in the case of a single swing operation, pitching in the upright direction can be suppressed even if the hysteresis width (=d2-d1) is smaller than that in the other single operations. Accordingly, in the present embodiment, the hysteresis in a single swing operation is set smaller than that in other single operations in order to improve the working efficiency of the single swing operation.

SUMMARY

The work machine 200 in the present embodiment includes the plurality of actuators 5*a*, 6*a*, 7*a*, and 8*a* to make actions of the machine main body 2 and the work device 210, and the lower track structure 1, the machine main body 2 is the upper swing structure 2 swingably mounted on the lower track structure 1, the actuators 5*a*, 6*a*, 7*a*, and 8*a* include the swing motor 8*a* that drives the upper swing structure 2, and the controller 20 determines, on the basis of operation amounts of the operation devices 15L and 15R, whether an operation of the operation devices 15L and 15R is a combined operation that simultaneously operates two or more of the plurality of actuators 5*a*, 6*a*, 7*a*, and 8*a* or a single swing operation that operates only the swing motor 8*a*, and determines the action of the work device 210 as the moving action if the operation of the operation devices 15L and 15R is determined as the combined operation or the single swing operation, but determines the action of the work device 210 as the positioning action if the operation of the operation devices 15L and 15R is determined neither the combined operation nor the single swing operation.

In the present embodiment configured as described above, too, advantages similar to those in the first embodiment can be achieved. Further, the action of the work device 210 by a single swing operation is determined as a moving action, and the hysteresis width (=d2-d1) of the target surface distance is smaller than the hysteresis width (=d2-d1) in a positioning action, so that the working efficiency of the single swing operation can be improved.

In addition, the controller 20 in the present embodiment sets the second distance d2 at different values between in the case where the operation of the operation devices 15L and 15R is determined as a combined operation and in the case where the operation of the operation devices 15L and 15R is determined as a single swing operation. This makes it possible to optimize each of the hysteresis width (=d2-d1) for a moving action by a combined operation and the hysteresis width (=d3-d1) for a moving action by a single swing operation.

Third Embodiment

About a work machine according to a third embodiment of the present invention, a description will be made centering around differences from the first and second embodiments.

Figure 9:
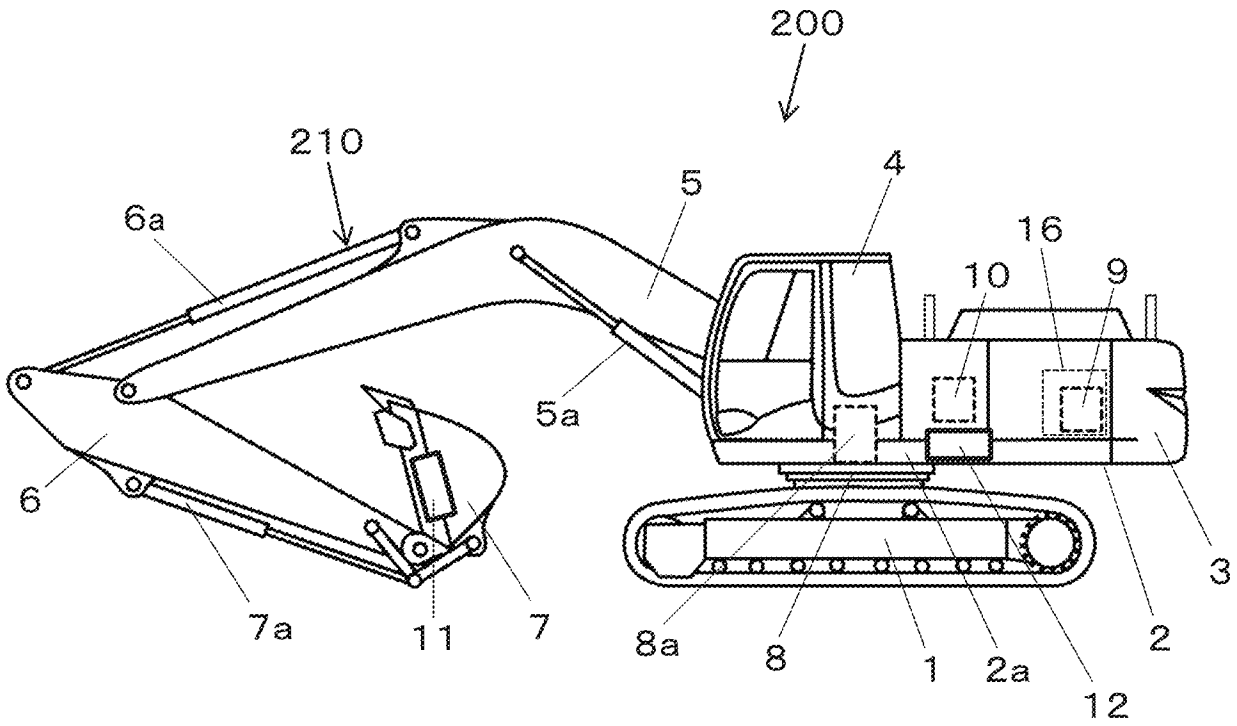
FIG. 9 is a side view of the hydraulic excavator according to a third embodiment of the present invention.

FIG. 9 is a side view of the hydraulic excavator according to the present embodiment. In FIG. 9, attached to the upper swing structure 2 is an angle sensor 12 that senses an inclination angle of the upper swing structure 2 (machine body inclination angle).

Figure 10:
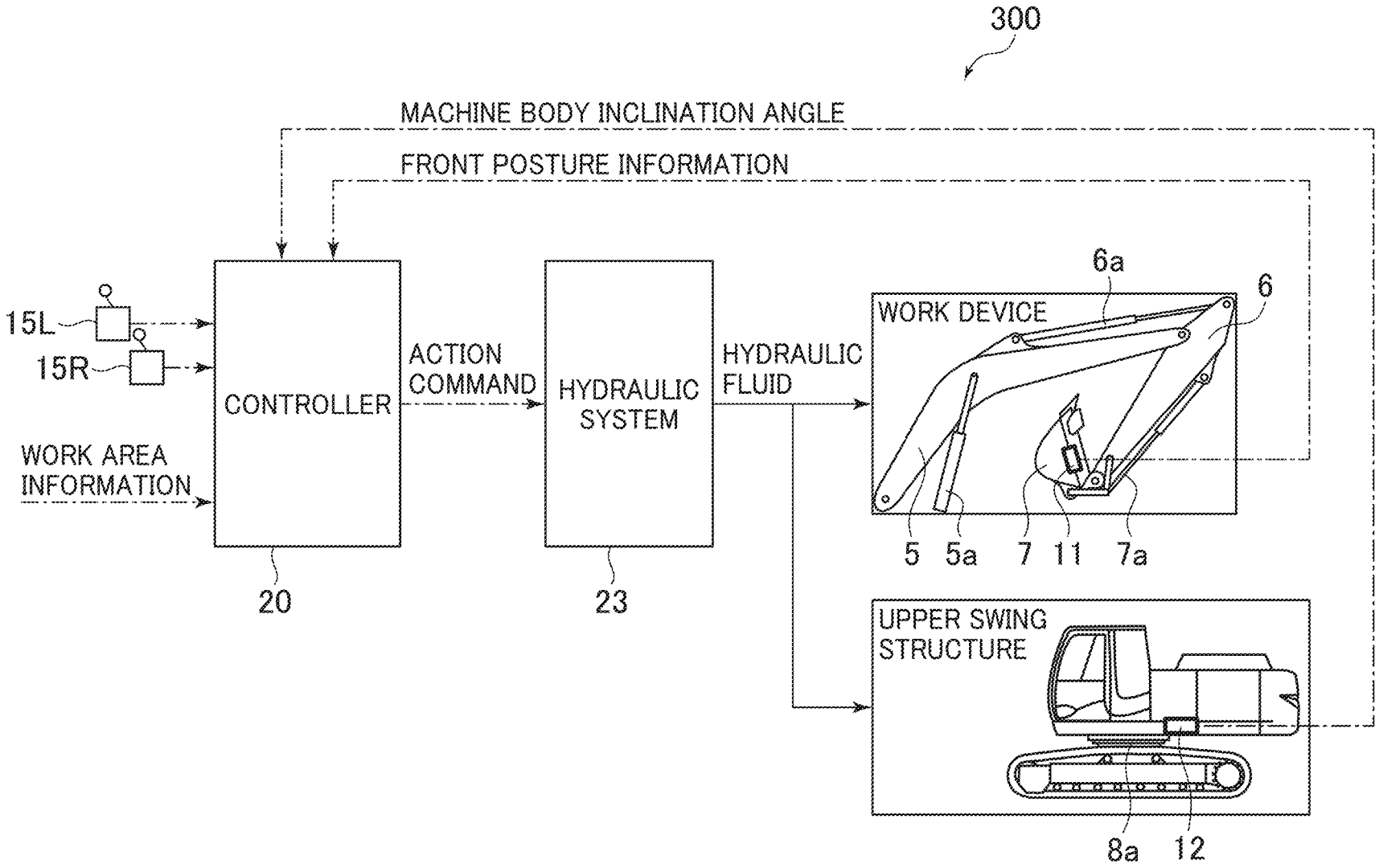
FIG. 10 is a configuration diagram of the hydraulic control system in the third embodiment of the present invention.

FIG. 10 is a configuration diagram of the hydraulic control system in the present embodiment. In FIG. 10, the controller 20 outputs a action command to the hydraulic system 23 according to the operation signals from the control levers 15L and 15R, the work area information, the bucket position information from the bucket position measurement system 11, and the machine body inclination angle.

Figure 11:
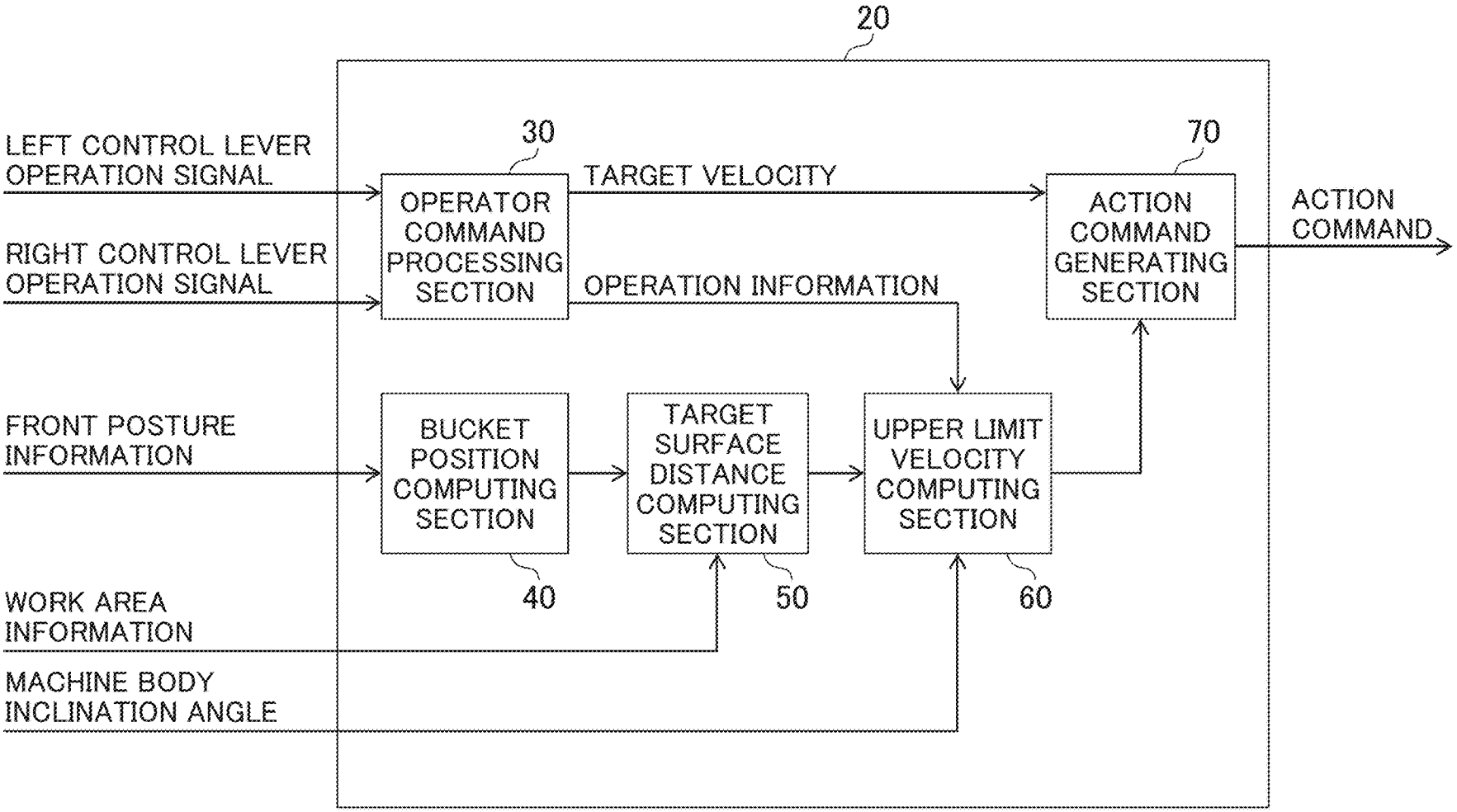
FIG. 11 is a function block diagram of the controller in the third embodiment of the present invention.

FIG. 11 is a function block diagram of the controller in the present embodiment. In FIG. 11, the upper limit velocity computing section 60 computes the upper limit velocities of the actuators 5*a*, 6*a*, 7*a*, and 8*a* on the basis of the operation information inputted from the operator command processing section 30, the target surface distance inputted from the target surface distance computing section 50, and the machine body inclination angle inputted from the angle sensor 12, and outputs the computed upper limit velocities to the action command generating section 70.

Figure 12:
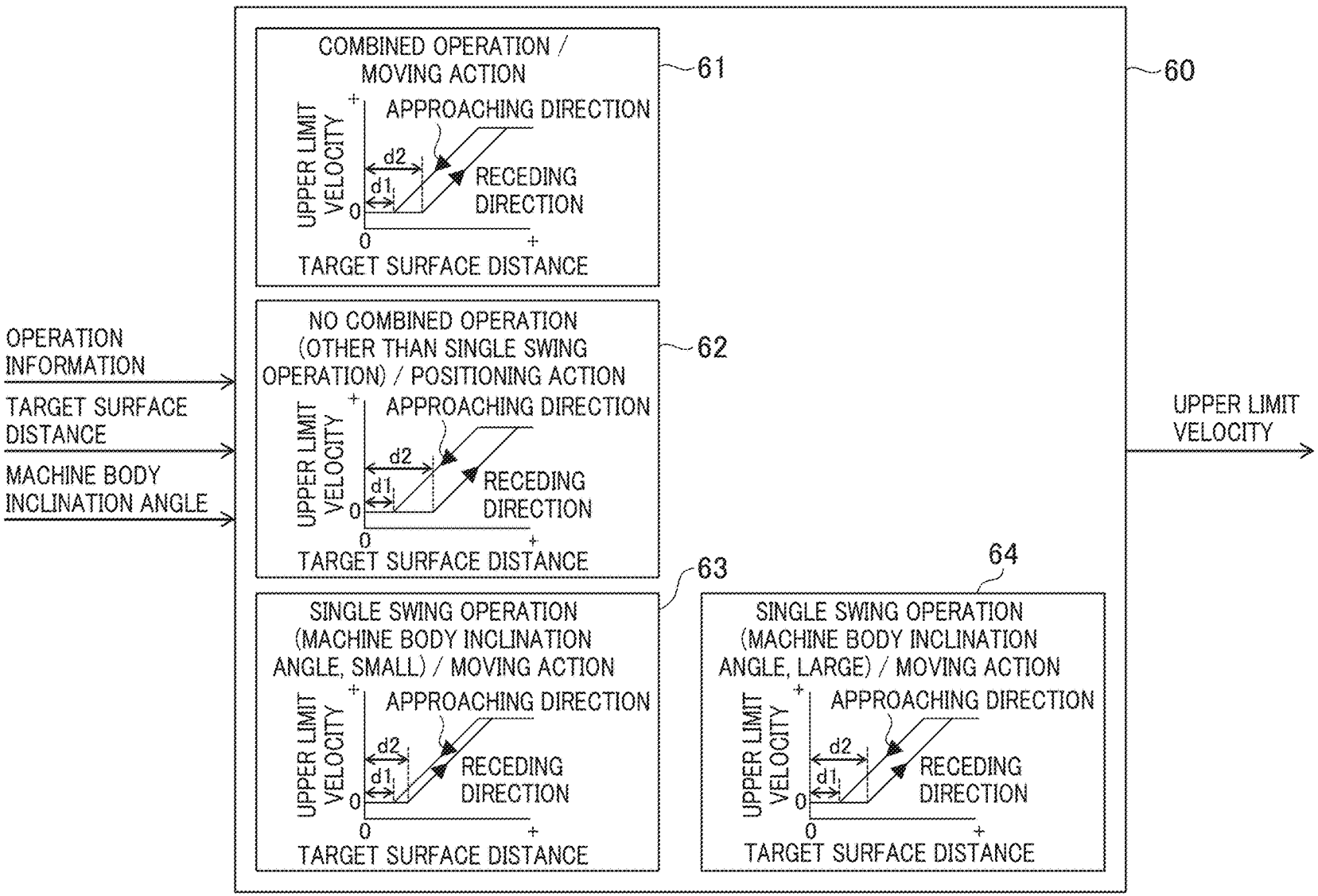
FIG. 12 is a diagram illustrating processing by the upper limit velocity computing section in the third embodiment of the present invention.

FIG. 12 is a diagram illustrating processing by the upper limit velocity computing section 60 in the present embodiment. In FIG. 12, the upper limit velocity computing section 60 has a fourth upper limit velocity computing section 64 in addition to the first to third upper limit velocity computing sections 61 to 63. The third upper limit velocity computing section 63 converts a target surface distance to an upper limit velocity if the operation information indicates "single swing operation" and the machine body inclination angle is small (if the machine body inclination angle is equal to or smaller than a predetermined threshold level), and the fourth upper limit velocity computing section 64 converts the target surface distance to an upper limit velocity if the operation information indicates "single swing operation" and the machine body inclination angle is large (if the machine body inclination angle is larger than the predetermined threshold level). The threshold level of the machine body inclination angle can be decided on the basis of a relation between the machine body inclination angle and the magnitude of vibrations in the up-down direction that occur by a single swing action. The fourth upper limit velocity computing section 64 has a configuration similar to that of the third upper limit velocity computing section 63, but the hysteresis width (=d2-d1) is larger than that of the third upper limit velocity computing section 63.

Here, the reason will be mentioned on the selective use of the third upper limit velocity computing section 63 or the fourth upper limit velocity computing section 64 according to the machine body inclination angle.

Figure 13:
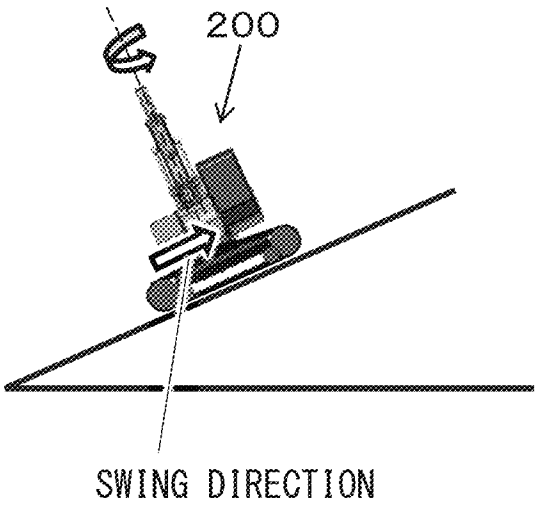
FIG. 13 is a diagram illustrating a relation between a single swing action on a steep slope and pitching in an upright direction.

If the hydraulic excavator 200 performs a single swing action on a horizontal surface, no large pitching in the upright direction occurs on the upper swing structure 2 or the work device 210 during swing braking because a velocity in a swing direction includes only a velocity component in a horizontal direction (lateral direction). It is therefore unnecessary to make the hysteresis width large for suppressing the pitching in the upright direction of the upper swing structure 2 or the work device 210. If a single swing action is performed on a steep slope as illustrated in FIG. 13, however, large pitching in the upright direction may occur on the upper swing structure 2 or the work device 210 during swing braking because the velocity in the swing direction includes a velocity component in the vertical direction (upright direction). In the present embodiment, if the machine body inclination angle is large, the fourth upper limit velocity computing section 64 in which the hysteresis width (=d2-d1) is large should therefore be used to suppress pitching in the upright direction of the upper swing structure 2 or the work device 210 during swing braking.

SUMMARY

The work machine 200 in the present embodiment includes the angle sensor 12 that senses an inclination angle of the machine main body 2, and the controller 20 sets, if an operation of the operation devices 15L and 15R is determined as a single swing operation and the inclination angle is greater than a predetermined threshold level, the second distance d2 at a value greater than the second distance d2 set when an operation of the operation devices 15L and 15R is determined as a single swing operation and the inclination angle is equal to or smaller than the threshold level.

In the present embodiment configured as described above, too, advantages similar to those in the second embodiment can be achieved. Further, pitching in the upright direction of the upper swing structure 2 or the work device 210 can be suppressed when the work machine 200 performs a single swing action on a steep slope.

The embodiments of the present invention have been described above in detail. However, the present invention is not limited to the above-described embodiments and encompasses various modifications. For example, the above-described embodiments are described in detail to illustrate the present invention so that understanding is facilitated, and the present invention is not necessarily limited to those including all the illustrated elements. Further, a part of the elements of one of the embodiments can be added to the elements of another one of the embodiments, and a part of the elements of one of the embodiments can be deleted, or replaced by a part of another one of the embodiments.

DESCRIPTION OF REFERENCE CHARACTERS

1: Lower track structure
2: Upper swing structure (machine main body)
3: Counterweight
4: Cab
5: Boom
5*a*: Boom cylinder (actuator)
6: Arm
6*a*: Arm cylinder (actuator)
7: Bucket (work instrument)
7*a*: Bucket cylinder (actuator)
8: Swing device
8*a*: Swing motor (actuator)
9: Pump unit
10: Control valve unit
11: Bucket position measurement system
12: Angle sensor
15L: Left control lever (operation device)
15R: Right control lever (operation device)
16: Engine
20: Controller
23: Hydraulic system
30: Operator command processing section
31: First target velocity computing section
32: Second target velocity computing section
33: Operation determining section
40: Bucket position computing section
50: Target surface distance computing section
60: Upper limit velocity computing section
61: First upper limit velocity computing section
62: Second upper limit velocity computing section
63: Third upper limit velocity computing section
64: Fourth upper limit velocity computing section
70: Action command generating section
200: Hydraulic excavator (work machine)

The invention claimed is:

1. A work machine comprising:

a machine main body;

an articulated work device that includes a work instrument and is attached to the machine main body;

an operation device that provides instructions on actions of the machine main body and the work device; and a controller that performs work range limiting control to decelerate or stop an action of the machine main body or the work device according to a distance between a monitor point set on the work device and an entry prohibited area such that the monitor point does not enter the entry prohibited area;

the controller starting the work range limiting control when the distance between the monitor point and the entry prohibited area decreases to a first distance, and ending the work range limiting control when the distance between the monitor point and the entry prohibited area increases to a second distance greater than the first distance, wherein the controller is configured to change the second distance according to an operation amount of the operation device.

2. The work machine according to claim 1, wherein the controller is configured to determine, on a basis of the operation amount of the operation device, whether an action of the work device is a positioning action to decide a position of the work instrument or a moving action to move the work instrument, set the second distance at a predetermined first value if the action of the work device is determined as the positioning action, and set the second distance at a predetermined second value smaller than the predetermined first value if the action of the work device is determined as the moving action.

3. The work machine according to claim 2, comprising:

a plurality of actuators that make actions of the work device, wherein the controller is configured to determine, on the basis of the operation amount of the operation device, whether or not an operation of the operation device is a combined operation to operate two or more of the plurality of actuators at the same time, determine that the action of the work device is the moving action if the operation of the operation device is determined as the combined operation, and determine that the action of the work device is the positioning action if the operation of the operation device is determined not to be the combined operation.

4. The work machine according to claim 3, wherein the controller is configured to determine that the operation of the operation device is the combined operation if two or more of the plurality of actuators have a target velocity greater than zero, and determine that the operation of the operation device is not the combined operation if one or less of the plurality of actuators has a target velocity greater than zero.

5. The work machine according to claim 2, wherein the controller is configured to determine the action of the work device as the positioning action if the monitor point has a greater velocity component perpendicular to the entry prohibited area than a velocity component parallel to the entry prohibited area, and determine the action of the work device as the moving action if the perpendicular velocity component is equal to or smaller than the parallel velocity component.

6. The work machine according to claim 2, comprising:

a plurality of actuators that make actions of the machine main body and the work device; and a lower track structure, wherein the machine main body is an upper swing structure swingably mounted on the lower track structure, the plurality of actuators include a swing motor that drives the upper swing structure, and the controller is configured to determine, on the basis of the operation amount of the operation device, whether an operation of the operation device is a combined operation to operate two or more of the plurality of actuators at the same time or a single swing operation to operate only the swing motor, determine that the action of the work device is the moving action if the operation of the operation device is determined as the combined operation or the single swing operation, and determine that the action of the work device is the positioning action if the operation of the operation device is determined as neither the combined operation nor the single swing operation.

7. The work machine according to claim 6, wherein the controller is configured to set the second distance at different values between in a case where the operation of the operation device is determined as the combined operation and in a case where the operation of the operation device is determined as the single swing operation.

8. The work machine according to claim 7, comprising:

an angle sensor that senses an inclination angle of the machine main body, wherein the controller is configured to set, in a case where the operation of the operation device is determined as the single swing operation and the inclination angle is greater than a predetermined threshold level, the second distance at a value greater than the second distance that is set in a case where the operation of the operation device is determined as the single swing operation and the inclination angle is equal to or smaller than the predetermined threshold level.

* * * * *